US007402097B2

(12) United States Patent
Esslinger et al.

(10) Patent No.: US 7,402,097 B2
(45) Date of Patent: Jul. 22, 2008

(54) TRACK SUPPORTED BORE FINISHING DEVICE

(75) Inventors: Thomas Esslinger, Alstead, NH (US); Erik Esslinger, Charlestown, NH (US)

(73) Assignee: Bore Repair Systems, Inc., Alstead, NH (US)

( * ) Notice: Subject to any disclaimer, the term of this patent is extended or adjusted under 35 U.S.C. 154(b) by 178 days.

(21) Appl. No.: 11/233,780

(22) Filed: Sep. 23, 2005

(65) Prior Publication Data

US 2006/0068686 A1 Mar. 30, 2006

(51) Int. Cl.
*B24B 9/00* (2006.01)

(52) U.S. Cl. ..... 451/180; 451/51; 451/61

(58) Field of Classification Search ..... 409/143; 451/21, 51, 61, 178, 180, 462
See application file for complete search history.

(56) References Cited

U.S. PATENT DOCUMENTS 2,647,348 A * 8/1953 Hahn ..... 451/14
2,680,941 A * 6/1954 Hahn ..... 451/27
3,032,932 A * 5/1962 Bargren ..... 451/124
3,688,443 A * 9/1972 Hohler ..... 451/21
4,096,667 A * 6/1978 Uhtenwoldt et al. ..... 451/236
4,845,895 A * 7/1989 Kihara et al. ..... 451/180
4,956,945 A * 9/1990 Ooshima ..... 451/1
6,475,073 B2 * 11/2002 Naoi ..... 451/180
6,994,610 B1 * 2/2006 Aiura et al. ..... 451/51

* cited by examiner

*Primary Examiner*—Timothy V Eley
(74) *Attorney, Agent, or Firm*—Davis Bujold & Daniels, P.L.L.C.

(57) ABSTRACT

A bore honing device comprising a support assembly including first and second end support elements connected by a base support which supports an axial guide track. A trolley engaging with the guide track and the trolley being movable along the guide track for guide movement of a bore honing tool supported by the trolley. At least one adjustable guide is provided for limiting travel of the trolley along the guide track. A weight compensation mechanism is connected between the trolley and a desired end wall of the support assembly for exerting a force on the support assembly when a bore honing device is vertically oriented to compensate for the weight of the drive motor, the trolley and the honing tool.

17 Claims, 6 Drawing Sheets

TRACK SUPPORTED BORE FINISHING DEVICE

FIELD OF THE INVENTION

The present invention relates to a track supported bore finishing device and more specifically to a device for accurately cutting, honing and finishing a bore hole in a desired part or item.

BACKGROUND OF THE INVENTION

The boring or re-boring of holes to tight tolerances in various metals, as when initially forming a cylinder bore or repairing a cylinder bore which has been damaged for some reason, is a common machining problem in the art and can be difficult.

A typical method for boring a hole to a set of required dimensions is to first bore or ream out an opening to an initial diameter which is close to but slightly smaller than the final bore diameter, and to lesser tolerances, with the initial opening then being honed and finished to a final bore diameter with the desired tolerances by use of a honing tool. Such finishing hones for bores are well known in the art and typically include, for example, a number of finishing or grinding surfaces or stones supported on a frame which permits adjustment, in the radial direction, of the diameter of the grinding stones so that the grinding stones can be located against and grind bores having different diameters.

In the case of repairing a damaged bore, for example, the typical repair process will first comprising filling the damaged portion of the bore with a sufficient amount of a desired weld material such that the portion of the bore filled with the weld material has a diameter which is somewhat less than the diameter of the original, undamaged bore. This filling step of the process is typically performed by a conventional bore repair welding device, which is well known in the art, wherein a radially adjustable welding tip is inserted into the damaged area of the bore and rotated to deposit the weld material circumferentially along the damaged inner surface of the bore. Once a sufficient amount of the weld material is deposited, the conventional bore repair welding device is removed and a boring finishing device, such as a cutter mounted on a drill, is inserted within the bore and rotated to order to shave, cut and/or remove excess weld material and eventually achieve a desired bore diameter. In certain instances, the dimensional and alignment accuracies that can be obtained with the cutter are sufficient to meet necessary requirements, and the process is completed solely by use of the rotating cutter.

Many other instances, however, require greater dimensional and alignment accuracies for the bore. In such cases, the cutter merely cuts the bore so that the interior diameter of the bore is sufficiently close to but slightly less than the desired final diameter for the bore. Thereafter, a honing tool is used to hone the diameter and alignment of the bore to the desired final dimensions and tolerances, such as to finish the bore to a desired diameter having a tolerance, for example, of ±0.0005 of an inch or less.

The above processes present a number of problems such as boring tool deflection, bearing play, tool wear, variable hardness in the material, and adjusting the boring tool to a proper radial alignment and dimensions. Further, manual physical manipulation of a conventional bore honing tool, during use, is often cumbersome. These problems tend to be somewhat lessened if the bore being finished has a relative small diameter and length, and such bores are often finished with a stationary hone. That is, a hone which may be clamped or held in a completely stationary position.

The above noted problems, however, become much more significant if the bore is relatively large or relatively long or if the workpiece being finished is relatively large or bulky because such situations typically require a relatively large and heavy boring tool and a corresponding heavy duty motor, such as a large portable drill, to adequately drive the boring tool at a desired rotational speed and with sufficient torque. The honing tools are often designed to be portable because they are often necessary, or at least preferable, when repairing a bore on site. As a result, the honing tool and the motor are typically supported and manipulated directly by the operator, as is conventional in the art. However, because of the weight, the size and the power requirements of the honing tool and the associated drive motor, it is often difficult for an operator to support and manipulate the honing tool and drive motor. These factors result in difficulties in meeting the required bore dimensional and alignment tolerances, significantly increase the time required to complete a honing process, lead to operator fatigue and may possibly create a safety issue which could lead to damage to the honing tool or injury to the operator.

For example, the concentration and physical effort required of the operator just to support and manipulate the honing tool and the drive motor makes it difficult for the operator to notice relatively small changes in the rotational speed and/or the axial position of the honing tool, even though such changes are often indicative of the axial force required to feed or withdraw the tool, such as in compensating for variations in the material hardness or thickness. In addition, portable hones often require a significant amount of axial movement and thus the honing tool is often connected to the drive motor via a drive shaft and a universal joint. This, in turn, leads to an increased risk that the tool can be pulled out of or otherwise be inadvertently removed from the bore during the honing process due to operator error from fatigue or the physical effort required to manipulate the tool, resulting in the hone deflecting radially and swinging around in an uncontrolled fashion.

It will be appreciated that these problems are increased significantly when honing a vertically extending bore since the operator is also then required not only to support the weight of the tool and the motor but also to apply force to the tool and the motor in an upward and downward manner, often in a cramped position.

The present invention addresses these and other related problems associated with the prior art devices and techniques for repairing and finishing a damaged bore.

SUMMARY OF THE INVENTION

The present invention is directed to a bore honing device including a support assembly having first and second end support elements connected with one another by a track support supporting an axial guide track and a trolley mounted on the guide track and engaging the guide track for sliding axial movement along an axis extending generally parallel to a bore for mounting a motor for driving a honing tool. A guide member is mounted between the first and second end support elements of the support assembly and parallel to the guide track and the trolley engages and is axially movable along the guide member with first and second axially adjustable guide stops being arranged on the guide member to determine a range of axial movement of the trolley.

In a preferred embodiment the bore honing device further includes a weight compensation mechanism connected between the trolley and a selected one of the first and second end support elements of the support assembly to exert a generally constant force on the support assembly in an upward direction when the bore and bore honing tool are oriented vertically, the force being selected to generally compensate for a weight of the motor and trolley.

The weight compensation mechanism may include at least one coil spring mounted onto the trolley, an end attachment on a free end of the at least one coil spring, a spring anchor located on the selected one of the first and second end support elements, and a locking device connecting the end attachment of the coil spring to the spring anchor.

The bore honing device may also include an adapter structure for mounting the honing device in a desired relationship with the bore of a workpiece with an axis of the honing tool generally aligned with an axis of the bore.

In addition, the guide track may be mounted to a top surface of the track support and may have a generally rectangular cross section with a generally flat upper bearing surface. A lower part of the trolley may include a trolley structure moveably bearing on the upper bearing surface of the guide track, and downward edge extensions engaging slots extending axially along sides of the guide track.

The bore honing tool may also include a bore honing tool, a drive motor mounted to the drive mount, and a universal joint and a drive shaft connecting the drive motor to the bore honing tool. In addition, the motor may be a portable electric drill having a handle end with a handle for supporting and guiding the electric drill and a switch for activating the electric drill and a drive output end engaging the trolley and having a drill clutch for engaging a universal joint connected to a drive shaft for driving the honing tool.

BRIEF DESCRIPTION OF THE DRAWINGS

The invention will now be described, by way of example, with reference to the accompanying drawings in which.

DETAILED DESCRIPTION OF THE INVENTION

Figure 1:
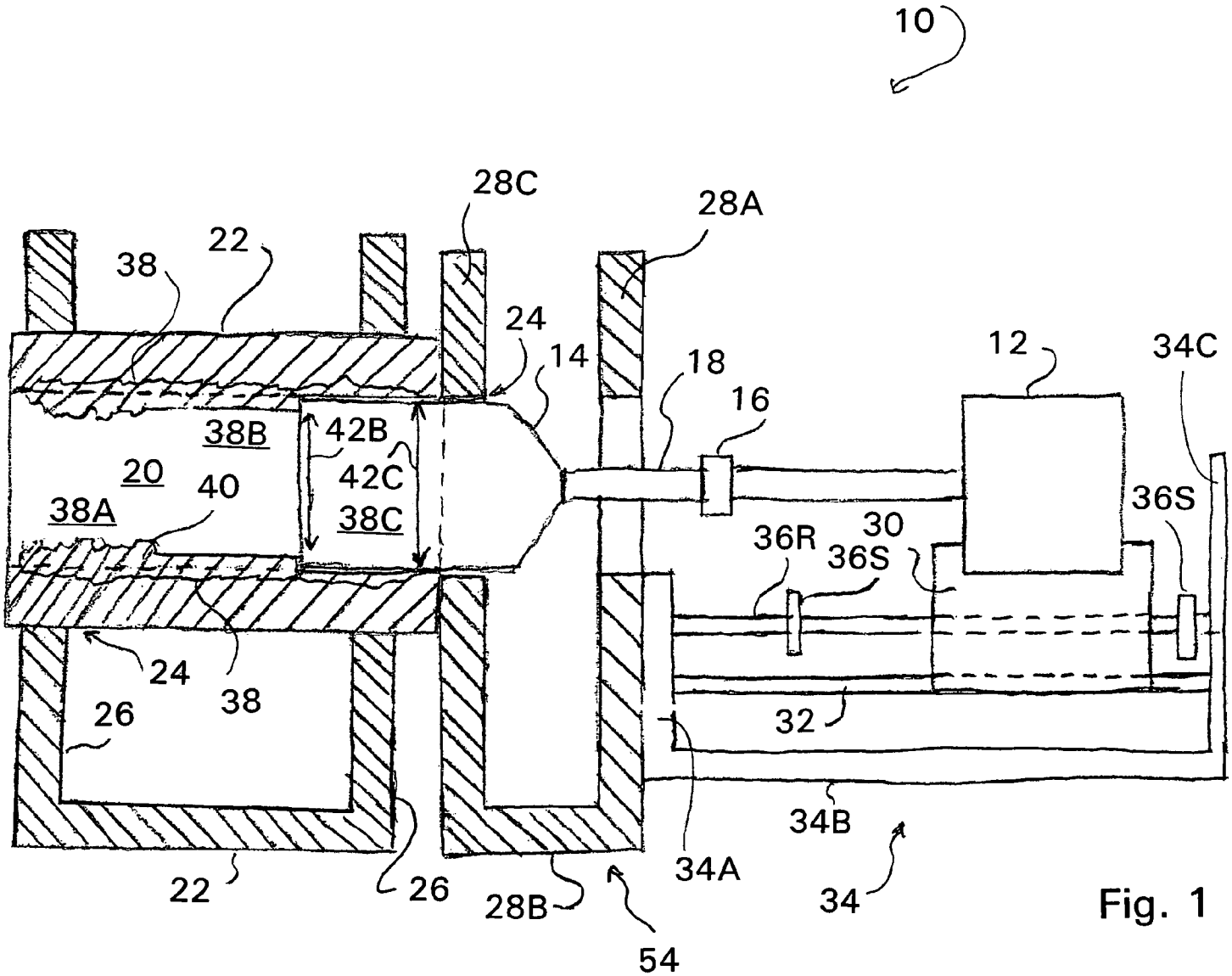
FIG. 1 is a diagrammatic cross sectional representation of a bore honing device according to the present invention.

Referring to FIG. 1, a diagrammatic cross sectional representation of a bore honing device 10, according to the present invention, is shown therein. As illustrated in this Figure, the bore honing device 10 includes a support assembly 34 which supports a drive motor 12 that is connected to supply rotational drive to a supported honing tool 14 via a universal joint 16 and a drive shaft 18. The honing tool 14 is generally self supported and/or self aligned within a bore 20 of a workpiece 22 to be finished. An adapter alignment assembly 54, which can have a variety of different shapes, sizes and/or configurations, facilitates direct attachment of the bore honing device 10 to a desired surface of the workpiece 22 with the bore 20 to be finished. The adapter alignment assembly 54, shown in FIG. 1, generally comprises a pair of opposed parallel planar side walls 28A, 28C which are interconnected with one another via a base wall 28B to form a generally U-shaped adaptor. Each of the side walls 28A, 28C has a plurality of attachment holes or other conventional alignment/attachment features which facilitate attachment of the bore honing device 10, via the adapter alignment assembly 54, to the desired workpiece 22 in a conventional fashion.

The support assembly 34 generally comprises opposed first and second end support elements 34A, 34C which are interconnected with one another by a rigid support base 34B. Preferably, but not necessarily, one end of the support base 34B is fixedly attached to the first end support element 34A, e.g., by welding for example, while the second opposite end of the support base 34B is releaseably attached to the second end support element 34C by one or more conventional fasteners 24, e.g., two bolts for example, to facilitate modification of the bore honing device 10 for either a left handed or right handed operator, as will be discussed below in further detail. An elongate guide rail or track 32 is carried by or attached to an upwardly facing surface of the support base 34B of the support assembly 34 by one or more conventional fasteners (see FIG. 3A). An axially moveable trolley 30 is supported by and is axially guided and slidable along the guide track 32. A motor support bracket 56 is affixed to and extends vertically from a top surface of the trolley 30 and fixedly supports the drive motor 12 so that any movement of the trolley 30, along the guide track 32, results in a corresponding movement of the drive motor 12, when supported thereby.

A guide rod or member 36R is supported by and extends between the first and second end support elements 34A, 34C parallel to the guide track 32. One end of the guide member 36R is threadedly engaged with a first one of the mating threaded hole 26 formed in the first end support element 34A while the second opposite end of the guide member 36R is closely releaseably received within a corresponding guide hole 27 in the second end support element 34C and captively retained therein once the second end support element 34C is affixed to the base support 34B by the one or more conventional fasteners 24. It is to be appreciated that the guide member alternatively could be, for example, a slot, groove or some other confined guide formed in the support base 34B along with a pair of associated adjustable guide stops movable along the support base 34B to limit axial movement of the trolley 30.

Figure 3:
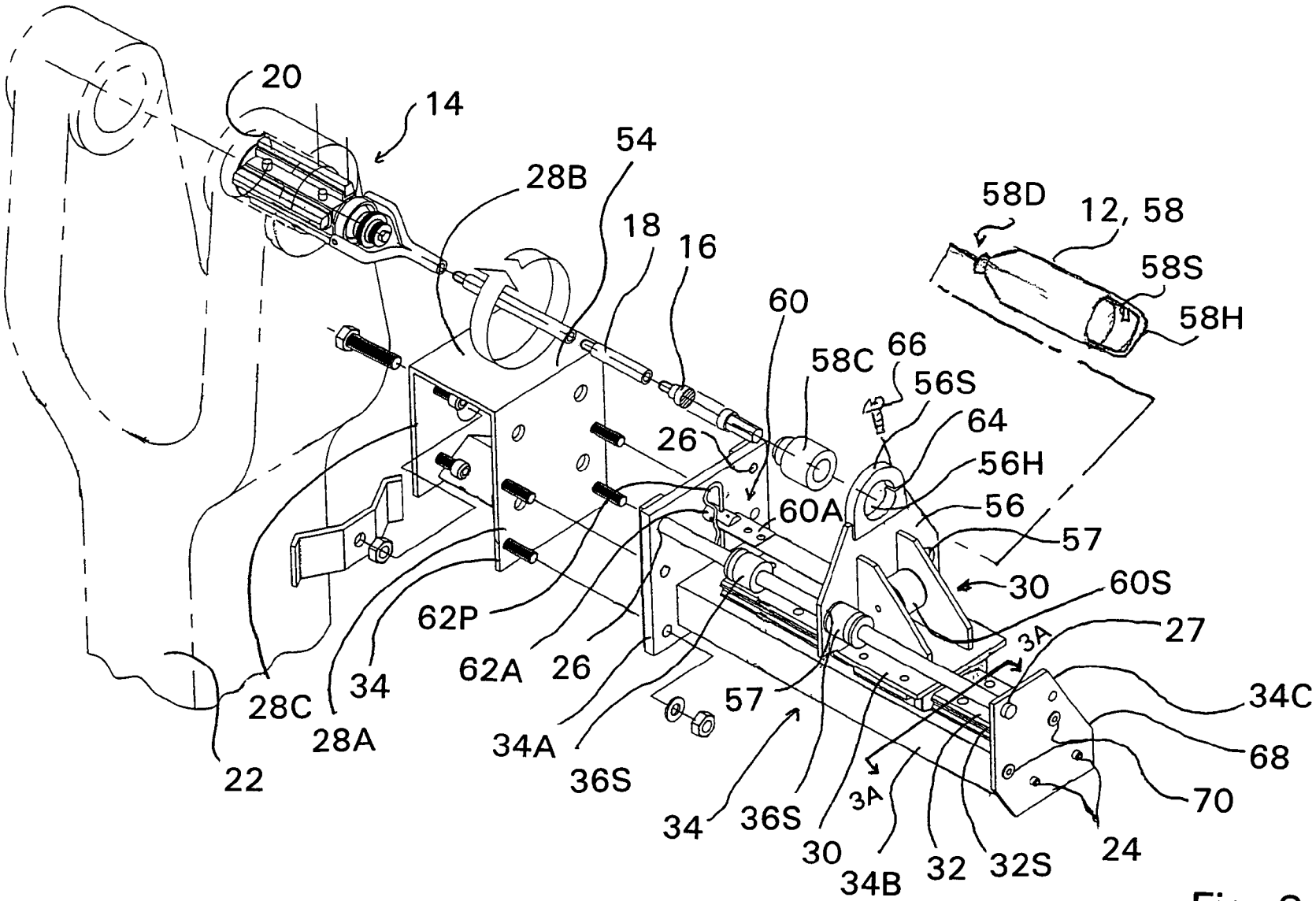
FIG. 3 is a diagrammatic isometric illustration of a bore honing device.

As shown in FIG. 3, the motor support bracket 56 has a pair of spaced apart guide apertures 57 and one of these guide apertures 57 (e.g., the left one as can be seen in FIG. 3) surrounds and engages with an intermediate section of the guide member 36R. A pair of adjustable spaced apart guide stops 36S are supported by the guide member 36R to adjust the amount of permitted axial movement or travel of the trolley 30 along the guide track 32, and thereby also control and limit the amount of axial movement of the drive motor 12 and the honing tool 14 during use thereof. A conventional rubber grommet is received within each of the guide apertures 57 and this grommet surrounds the guide member 36R, with a slight clearance, for cushioning the trolley 30 as the trolley 30 as moves to and fro along guide track 32 and abuts with either one of the adjustable guide stops 36S.

With reference to FIG. 1, a diagrammatically cross sectional illustration of the internal configuration of a typical bore 20 of a workpiece 22 that is undergoing repair is shown. This bore 20 to be repaired is first filled with a weld material, then cut to a rough diameter and finally honed and finished to a final diameter, as described above. As shown therein, the bore 20 includes a damaged area 38, e.g., an area which was either accidentally damaged or worn over time. The entire damage area 38 is first filled with a desired weld material 40, and a portion of damage area 38 is illustrated as rough filled area 38A which is still at the rough diameter 42A established by the initial filling of the weld material 40. In initial cutting area 38B, the bore 20 was cut by a conventional cutting tool to an intermediate diameter 42B that is close to but is still less than the final desired diameter 42C for the bore 20. In honed area 38C, the bore 20 is in the process of being honed and finished by the honing tool 14 to achieve the desired final diameter 42C having the required tolerances.

Figure 2A:
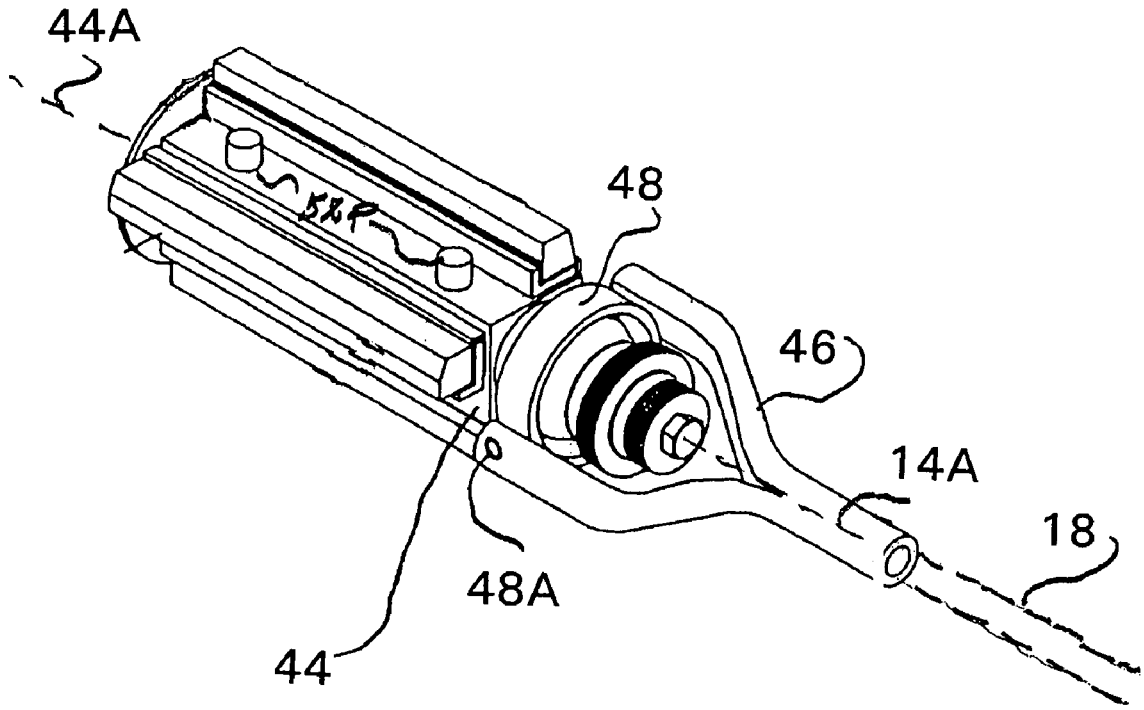
Fig. 2A Prior Art
FIG. 2A is a diagrammatic view of a prior art bore honing tool.
Figure 2B:
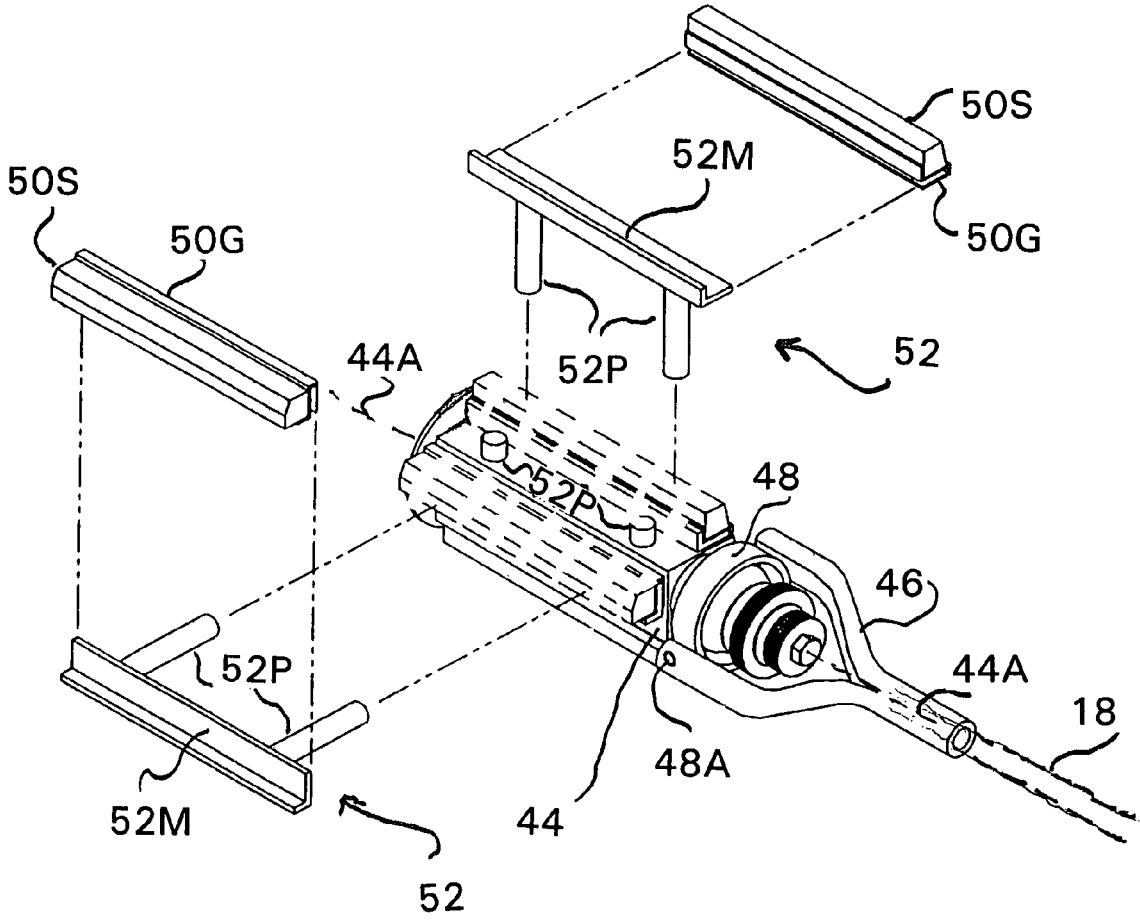
Fig. 2B Prior Art
FIG. 2B is a diagrammatic exploded view showing assembly of two of the to the bore honing tool to result in the bore honing tool as shown in FIG. 2A.

FIGS. 2A and 2B, respectively, are a diagrammatic view of an assembled bore honing tool 14 of the type that is conventional and well known in the art and frequently referred to as a "sizing head" and a diagrammatic exploded view showing partial assembly of the bore honing tool 14 of FIG. 2A. As shown, honing tool 14 includes a sizer body 44 which is connected to a drive yolk 46 by a drive ring 48 and two diametrically opposed pivot pins 48A. A remote end of the drive yolk 46 is, in turn, connected to the leading free end of the drive shaft 18 in a conventional manner and the pivoting connection between the drive yolk 46 and the sizer body 44, via the drive ring 48 and pivot pins 48A, allows coaxial rotation of the honing tool 14 within a bore 20 while the longitudinal axis 44A of the sizer body 44 may be axially offset with respect to the axis of drive shaft 18.

A plurality of elongated grinding stones 50S are mounted on and carried by corresponding guide blocks 50G and the guide blocks 50G, in turn, are adjustably mounted or fastened, in a conventional manner, to the outer circumference of the sizer body 44. Although, for the purpose of clarity of illustration, only two such grinding stones 50S are shown in FIGS. 2A and 2B, it is to be understood that a honing tool 42 will typically include a larger number of grinding stones 50S, such as four or more grinding stones equally spaced about the perimeter of the sizer body 44. As also shown, the grinding stones 50S are symmetrically distributed radially around the circumference of the sizer body 44 and are axially aligned along the axis 44A of the sizer body 44 by corresponding stone racks 52. Each stone rack 52 includes an elongated rack mount 52M for mounting and supporting a corresponding guide block 50G and grinding stone 50S and each rack mount 52M is connected to the sizer body 44 by a pair of rack pins 52P such that each rack mount 52M is radially offset from and axially aligned with the longitudinal axis 44A of the sizer body 44. As is conventional in the art, the honing tool 42 may be provided with one or more additional sets of stone racks 52, having either short or longer rack pins 52P, to facilitate honing of either smaller or larger diameter bores. It is to be appreciated that although FIGS. 2A and 2B only show stone racks 52, as is conventional in the art, each stone rack 52 supported by the size body 44 is typically immediately followed by a wiper. The wiper assists with removing the ground debris from the inner surface of the bore being finished and may carry a lubricant to assist the grinding process.

Although not shown in detail, each rack pin 52P has a toothed rack which engages with mating teeth of an axially elongated pinion gear located within the sizer body 44 to form a rack and pinion connection whereby the radial offset of the corresponding guide block 50G and honing stone 50S with respect to longitudinal axis 44A of the sizer body 44 can be adjusted by rotation of the pinion gear attached to a conventional rack and pinion type mechanism. The use of such a rack and pinion arrangement thereby allows the honing diameter of the honing tool 14 to expand and contract, in a precisely controlled manner as desired, and facilitate adjustment of the honing tool 14 to adjust to different diameters and even to flex, to some extent, and adjust to variations in the bore diameter and any inaccuracies or misalignment of the drive shaft 18 with respect to the bore 20.

Figure 3A:
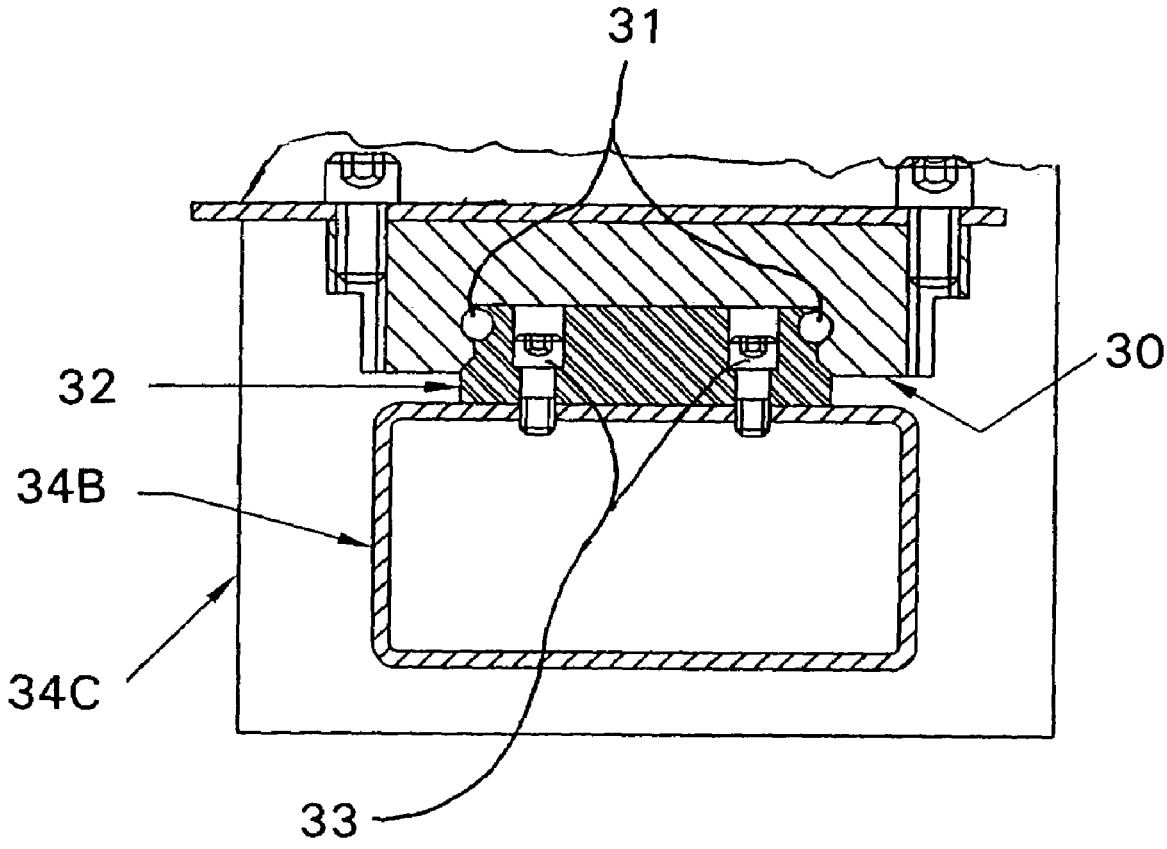
FIG. 3A is a diagrammatic cross sectional view of the trolley and guide track along section line 3A-3A of FIG. 3; and, FIG. 4 is a diagrammatic illustration of a weight compensation mechanism having dual coil springs.

Referring to FIGS. 3 and 3A, a further description of interaction and function of the bore honing device 10, the adapter alignment assembly 54 and other associated components, as described above with respect to FIGS. 1 and 2A and 2B, will now be provided.

As shown therein, the adapter alignment assembly 54 includes a plurality of mechanical interface adapter elements, alignment pins and bolts (not separately labeled), etc., as necessary, in order to achieve a secure attachment of the adapter alignment assembly 54 to the workpiece 22. As noted above, it will be understood that the elements or features of the adapter alignment assembly 54 can vary depending upon the mechanical adaptations necessary to secure the adapter alignment assembly 54 to the workpiece 22. The mating surfaces of the adapter alignment assembly 54 and the first end support element 34A are both generally planar and each, in turn, also includes a corresponding arrangement of alignment pins and bolts (not separately labeled), as necessary, to facilitate securing of the first end support element 34A, and thus the support assembly 34, to the adapter alignment assembly 54 in an appropriate alignment position for performing the desired bore honing operation.

The guide track 32 generally has a rectangular cross section, thereby providing a wide, flat upwardly facing bearing surface that is located to support a corresponding lower downwardly facing bottom surface of the trolley 30 (see FIG. 3A). As shown, the lateral side walls of the trolley 32 extend toward the base surface 34B and are located to engage and sandwich therebetween lateral slots 32S formed along the sides surfaces of the guide track 32 and thereby provide further guidance and support for the trolley 30 and the drive motor 12 and also ensure that the trolley 30 and the guide track 32 do not become inadvertently disengaged from one anther during use.

It will be understood that guide track 32 and the trolley 30 can be implemented in a number of different forms such as a trolley riding on a pair of parallel rods and having elements encompassing the rods to retain and guide the trolley as it moves along on the rods. The assembly of the guide track 32 and trolley 30 will also often include anti-friction elements, such as bearings 31 and/or bearing surfaces, to reduce the associated friction between the trolley 30 and the guide track 32 due to relative movement between the trolley 30 and the guide track 32. Alternatively, the guide track could be an elongate slot, groove or some other guide feature formed within the base surface 34B and a mating guide pin(s) engaging with and guiding the trolley 32 as it moves to and fro along the slot, groove or some other guide feature. In addition, the guide member and associated stops could have a variety of other different shapes and forms. The important aspect is that the trolley 30 only be able to move to and fro over a limited range of travel with the travel distance of the trolley 30 being adjustably determined and limited by the adjustable guide stops 36S.

As noted above, the motor support bracket 56 is secured to the top surface of the trolley 32, e.g., by screws 33 or welding, for example. The motor support bracket 56 comprises an upwardly extending motor support plate 56S having a circular opening 56H generally axially alignable with a longitudinal axis of the desired bore 20 to be finished by the honing tool 14. According to a preferred embodiment, the drive motor 12 comprises, for example, of an electric drill 58 having a handle 58H at one end which facilitates grasping and manipulation of the drive motor 12 by an operator. The handle 58H typically has a trigger or a switch 58S which controls activation and deactivation of the electrical power supplied to the drive motor 12, e.g., turns the drive motor 12 "on" and "off" and/or controls the rotational speed of the drive motor 12, as desired.

The other end of the electric drill terminates in a conventional drive output structure 58D that is received by and passes through the opening 56H in the motor support plate 56S. Preferably, the drive motor 12 includes a machined nonrotatable exterior cylindrical collar or some other similar exterior housing feature (e.g., a Milwaukee Drill D-Handle Drill, such as model number 1107-6 is provided with such a machined collar) which is capable of being captively received and retained within the opening 56H of the motor support plate 56S. The opening 56H is sized to be slightly larger, e.g., by a few thousands of an inch or so than the machined exterior cylindrical collar of the drive motor 12, and a cutout or slot 64 is provided in the support plate to facilitate reducing the internal diameter of the opening 56H and clamping of the motor support plate 56S about the machined exterior cylindrical collar once the machined collar is suitably received and located within the opening 56H. A set screw 66, or some other similar fastener or clamping device, is threaded into the motor support plate 56S, adjacent the cutout or slotted area 64, to assist with reducing the sized of the cutout or slot 64 and thus the diameter of the opening 56H around the circumference of the machined collar and captively attach and retain the drive motor 12 to the motor support plate 56S. It is to be appreciated that the drive motor 12 must be fixedly attached to the motor support plate 56S, is some manner, such that any movement of the trolley 30 induces an identical and corresponding movement in the motor drive 12, and vice versa.

The drive output structure 58D of drive motor 12 typically includes a conventional drill chuck 58C for engaging with one end of the drive shaft 18 via the universal joint 16 and thereby driving the honing tool 14. In this regard, it should be noted that the use of a conventional electric drill, as the drive motor 12, and the engaging the drive shaft 18 with the drill chuck 58C of the drive motor 12 is advantageous in that the drive motor 12 is thereby readily separable, as necessary or required, from a remainder of the bore honing device 10. Not only does this separability feature of the drive motor reduce the overall weight of the individual components of the bore honing device 10, thereby rendering the device significantly more portable and versatile, but it allows the use of the drive motor 12 for other purposes, such as an electric drill, when this drive motor 12 is not being utilized for bore honing operations.

It will also be appreciated that the drive motor 12 must firmly engage with motor support plate 56S to prevent any axial movement of the drive motor 12 with respect to trolley 30, during operation of bore honing device 10, to thereby ensure that all axial movement of the drive motor 12 and thus axial movement of the honing tool 14 is limited by guide stops 36S, as described below. It will be further appreciated that the engagement of drive motor 12 with motor support plate 56S should also prevent or limit any unwanted rotation of the drive motor 12 with respect to the motor support plate 56S when the drive motor 12 is driving the honing tool 14, again to ensure adequate control of the motion and operation of the honing tool 14. Such engagement between the drive motor 12 and motor support plate 56S can be accomplished in a variety of different and conventional ways that are familiar to those of ordinary skill in the relevant arts. For example, a portion of the circumference of the opening 56H in the motor support plate 56S may be provided with a hinge or some other clamping structure which will surround, receive and/or encase the drive motor 12 to facilitated clamping the exterior of the drive motor 12 to the motor support plate 56S. Alternatively, the handle of the drive motor 12 may be used to secure the drive motor 12 to the motor support plate 56S.

As shown in FIG. 3, the pair of adjustable guide stops 36S are supported by the guide member 36R with a first guide stop 36S being located between a first end of the trolley 30 and the first end support element 34A and the second guide stop 36S being located between a second end of the trolley 30 and the second end support element 34C. The pair of adjustable guide stops 36S facilitates adjustment of the range of axial travel or movement of the trolley 30 along the guide track 32, and thereby the range of axial travel or movement of the honing tool 14 within the bore 20 being finished.

In a typical implementation of the guide stops 36S, the stops are moveable along guide member 36R but are provided with a readily releaseably clamping mechanism having any form well known in the art, such as springs biased against guide member 36R or a set screw that can be tightened against guide member 36R to secure the guide stops 36S in a desired adjusted position and stop movement of the trolley. Guide member 36R and guide stops 36S limit axial travel of the trolley 30, and thus limit axial travel or movement of the honing tool 14. As discussed herein above, therefore, guide member 36R and guide stops 36S thereby prevent safety issues from arising should the honing tool 14 be inadvertently withdrawn from or pushed completely through of bore 20 while the honing tool 14 is rotating at significant rotational speed, thereby prevent damage to the operator, the bore honing device 10, the workpiece 22 and/or the surrounding environment.

As illustrated in detail in FIG. 3, the bore honing device 10 typically, but not necessarily, includes a weight compensation mechanism 60 which relieves the operator of at least some of the burden of supporting the bore honing device 10 during operation thereof. The weight compensation mechanism 60 is particularly useful when the bore honing device 10 is either vertically oriented, or substantially vertically oriented. That is, when the axis of the bore 20 being finished and thus of the drive motor 12, the trolley 30 and the honing tool 14 are all substantially vertically oriented. The weight compensation mechanism 60 is typically not utilized for horizontal applications. The weight compensation mechanism 60 assists the operator with manipulation of the bore honing device 10 by reducing the force that must be exerted by the operator when moving the bore honing device 10 vertically while honing a vertically oriented bore. The weight compensation mechanism 60 minimizes operator fatigue and thereby increases operator safety and generally results in a higher quality finished bore.

The weight compensation mechanism 60 generally comprises a spring assembly which is supported by the trolley 30. The spring assembly releaseably interconnects the trolley 30 with either the first and the second end support elements 34A and 34C, depending upon whether the bore 20 being finished is located vertically above the bore honing device 10, which generally requires that the bore honing device 10 be lifted vertically to drive the honing tool 14 vertically upward into the bore 20 being finished, or below the bore honing device 10, which requires generally that the bore honing device 10 be lifted vertically to remove and/or retract the honing tool 14 from the bore 20 being finished. In either instance, the weight compensation device 60 is designed to exert a substantially vertically upward constant force of about 15-20 pounds or so on the trolley 30, and thus the drive motor 12, to assist the operator with supporting and/or lifting the weight of the drive motor 12, the trolley 30 and the honing tool 14 when either inserting or retracting the honing tool 14 from the bore 20 being finished.

As shown in FIG. 3, the weight compensation device 60 includes a coil spring 60S supported by a removable spring axle 60X. The spring axle 60X is, in turn, supported by a pair of spaced apart spring support brackets 60B that are each attached to or integrally formed as part of the trolley 30. A remote free end of coil spring 60S passes through a spring opening (not shown in detail) in the motor support plate 56S is provided with an attachment mechanism 60A that facilitates releaseably engagement of the attachment mechanism 60A to a spring anchor 62A secured to a surface of the first end support element 34A by a removable locking device, such as a removable locking clip or pin 62P. A second spring anchor 62A may be secured to a surface of the second end support element 34C to facilitate releaseably attachment of the attachment mechanism 60A to the second end support element 34C by a removable locking device, such as a removable locking clip or pin 62P.

It is to be appreciated that other repeatedly releaseably locking arrangements may include, for example, a mating hook and eye arrangement or any other conventional mechanism that will facilitate repeated secure detachable connection of the free end of the coil spring 60S to either the first end support element 34A or the second end support element 34C. Alternatively, the spring anchor 62A may be attached to the first end support element 34A by welding, for example, or may be formed with an enlarged mushroom head, that is, as a rivet like element, extending through a hole in the first end support element 34A, so that the spring anchor 62A is held in place by the tension applied by the coil spring 60S.

In the instance when the bore honing device 10 is located below the workpiece 22, as illustrated in FIG. 3, the attachment mechanism 60A at the remote free end of coil spring 60S engages, via the removable locking pin 62P, with the spring anchor 62A secured to the first end support element 34A. As a result of such engagement, as the coil spring 60S uncoils or unwinds due to sliding movement of the trolley 30 along the guide track 32 in a direction away from the first end support element 34A, the coil spring 60S will generally exert a constant biasing force on the trolley 30 biasing the trolley 30 to return back toward the first end support element 34A. Such bias will, in turn, also induce a corresponding movement of the honing head 14, thereby providing a generally constant compensation for at least part of the weight of the drive motor 12, the trolley and the honing tool 14. It is to be appreciated that the constant biasing force to be exerted by the spring can vary, depending upon the particular type and/or size of coil spring utilized and the particular application.

In an instance wherein the bore 20 is vertically below the bore honing device 10, it is necessary that the force exerted by the weight compensation device 60 be exerted in the opposite direction from that described above. That is, the force must be exerted so as to urge the trolley 30 toward the second end support element 34C. To facilitate this, the attachment mechanism 60A at the remote free end of the coil spring 60S is connected to engage, via a removable locking pin 62P, with a spring anchor 62A secured to the second end support element 34C. As a result of such engagement, as the coil spring 60S uncoils or unwinds due to sliding movement of the trolley 30 along the guide track 32 in a direction away from the second end support element 34C, the coil spring 60S similarly exerts a constant biasing force on the trolley 30 biasing the trolley 30 to return back toward the second end support element 34C. This, in turn, will also induce a corresponding movement of the honing head 14, thereby providing a generally constant compensation for at least part of the weight of the drive motor 12, the trolley and the honing tool 14.

According to one implementation, only a single removable spring anchor 62A, having an enlarged head, may be provided and the single removable spring anchor 62A is removable, via a rear surface, from a corresponding hole in the first end support element 34A and inserted, from the rear surface of the second end support element 34C, into a correspond hole of the second end support element 34C with the enlarged head of the spring anchor 62A retaining and preventing the spring anchor 62A from completely passing therethrough. In addition, one the spring axle 60X is removed from the spring support brackets 60B and the coil spring 60S is removed from the spring opening in the motor support plate 56S, the coil spring 60S is rotated or around 180 degree so that the free end of the coil spring 60S is still located adjacent the top surface of the trolley 30 and suitably positioned to engage with the repositioned spring anchor 62A supported by the second end support element 34C. Thereafter, the spring axle 60X is then engaged with the spring support brackets 60B to secured the coil spring 60S to the trolley 30. As previously discussed, the attachment mechanism 60A facilitates releaseably engagement of the spring anchor 62A via the removable locking pin 62P. If desired, a second spring anchor 62A may be secured to the second end support element 34C to facilitate releaseably attachment thereto by a removable locking device, such as a removable locking pin 62P, without having to reposition either the coil spring 60S and/or the spring anchor 62A.

Figure 4:
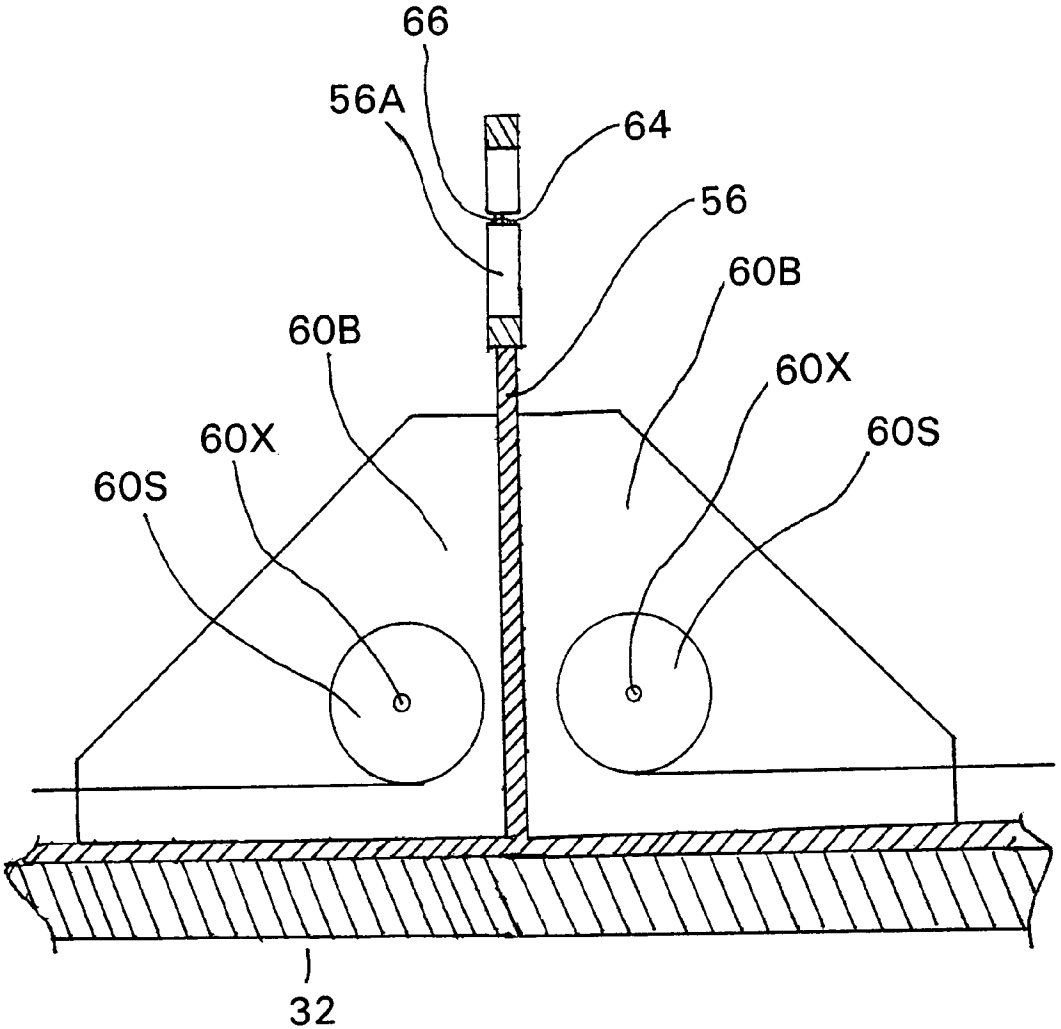

With regard to the coil spring 60S, a variety of other implementations are possible. For example, as illustrated in FIG. 4, a pair of coil springs 60S could be mounted on the trolley 30 with one of the pair of coil springs 60S arranged to releaseably engage with the spring anchor 62A supported by the first end support element 34A and the other of the pair of coil springs 60S arranged to releaseably engage with the spring anchor 62A supported by the second end support element 34C, depending on the arrangement of the honing device with respect to the workpiece 22, without having to modify the position of the coil spring(s) 60S and/or the spring anchors 62A.

As previously stated, the second end support element 34C is reversibly to suit either left or right handed operators. As can be seen in FIG. 3, the second end support element 34C is smaller in size than the first end support element 34A and has an angled wall 68 which is designed to provide minimal interference as the drive motor 12, when supported by the motor support plate 56S, is manipulated toward the second end support element 34C by the operator, so the second end support element 34C does not abut against or interfere with the handle 58H of the drive motor 12. In the event that the handle 58H of the drive motor 12 is to be angled toward the left instead of toward the right, as can be seen in FIG. 3, the one or more conventional fasteners 24 securing the second end support element 34C are removed so that the second end support element 34C can be completely removed from the support base 34B and the guide member 36R.

Next, the guide member 36R is disengaged from the mating threaded hole 26 formed in the first end support element 34A and then threadedly engaged with the other mating threaded hole 26 also formed in the first end support element 34A. It is to be appreciated that one of the guide stops 36S has to be removed from the guide member 36R so that the guide member 36R can be removed from the associated guide aperture 57 in the motor support plate 56S and then reinserted back onto the guide member 36R after the guide member 36R engages with the other guide aperture 57 in the motor support plate. Then the second end support element 34C is brought into engagement with the second end of support base 34B with the second opposite end of the guide member 36R being closely releaseably received within the other corresponding guide hole 27 in the second end support element 34C. Finally, the one or more conventional fasteners 24 are attached to affix the second end support element 34C to the base support 34B with the second end of the guide member 36R captively retained by the guide hole of the second end support element 34C.

It is to be appreciated that the first end of the boring device support is provided with a conventional attachment mechanism such as, for example, a plurality of bolt holes for attachment to a mounting plate. There are many type of mounting plates known in the art. The mounting plate is designed to specifically align the boring device with the hole to be bored and these are often times specific to the piece of equipment to be repaired. Any variations of the mounting device may be used to help align the boring device support and the boring device itself.

The second and/or first end support element(s) 34C, 34A may be provided with one or more additional holes which each support a grommet 70 to facilitated releaseably attachment of associated bore honing accessories, e.g., a chuck tighten wrench for example. This assists the operator with locating the bore honing accessories when needed.

Since certain changes may be made in the above described bore honing device, without departing from the spirit and scope of the invention herein involved, it is intended that all of the subject matter of the above description or shown in the accompanying drawings shall be interpreted merely as examples illustrating the inventive concept herein and shall not be construed as limiting the invention.

We claim:

1. A bore honing device comprising:

a support assembly including a first support element and a second support element which are connected by a support base, the support assembly supporting an axial guide track;

a trolley engages with and is movable along the guide track for guiding movement of a bore honing tool;

the trolley has a support for supporting the bore honing tool;

at least one adjustable guide stop is supported by the support assembly to limit axial movement of the trolley along the guide track; and an adapter alignment assembly comprises a pair of side walls which are interconnected with a base wall, and each of the pair of side walls has a plurality of attachment features to facilitate attaching the adapter alignment assembly to the support assembly and aligning the bore honing device with a bore to be finished.

2. The bore honing device according to claim 1, further comprising a drive motor coupled to the bore honing tool, via a drive shaft, to supply rotational drive to the bore honing tool.

3. The bore honing device according to claim 2, wherein the drive motor is an electric drill, which has a handle for supporting and guiding the electric drill, the electric drill includes a switch to power and drive the electric drill, and the electric drill has a drill chuck for supporting a sizing head, which hones a bore to a desired final diameter.

4. The honing device according to claim 2, wherein the guide track is mounted to a top surface of the base support and has a generally rectangular cross section with a generally flat upper bearing surface, a lower part of the trolley includes a trolley structure, which is moveably supported on the upper bearing surface of the guide track, and includes downward edge extensions that engage slots extending axially along sides of the guide track.

5. The bore honing device according to claim 1, wherein the adapter alignment assembly facilitates attachment of the bore honing device to a desired surface of a workpiece having the bore to be finished.

6. The bore honing device according to claim 1, wherein the guide track is coupled to a top surface of the support base, and one of the trolley and the guide track has an antifriction element, which facilitates movement of the trolley along the guide track.

7. The bore honing device according to claim 6, wherein the guide track has a flat upwardly facing surface, which supports a corresponding lower downwardly facing bottom surface of the trolley, and the trolley has opposed inwardly facing side walls to sandwich the guide track therebetween.

8. The bore honing device according to claim 1, wherein a pair of adjustable guide stops are supported by a guide member, which extends parallel to the guide track, to control an amount of axial movement of the trolley along the guide track.

9. The bore honing tool according to device 1, wherein a motor support bracket is secured to the trolley and has a releasable clamping mechanism for coupling a drive motor to the trolley.

10. The bore honing device of claim 1, further comprising:

a weight compensation mechanism is connected to and located between the trolley and one of the first support element and the second support element of the support assembly to exert a generally constant force on the support assembly in an upward direction when the bore and the bore honing device are oriented vertically, and the force being selected to generally compensate for a weight of a drive motor and the trolley.

11. The bore honing device according to claim 10, wherein the weight compensation mechanism comprises:

at least one coil spring, which mounted to the trolley, an end attachment coupled to a free end of the at least one coil spring, a spring anchor, which is connected to the one of the first support element and the second support element, and a locking device for connecting the end attachment to the spring anchor.

12. The bore honing device according to claim 10, further comprising:

the bore honing tool, the drive motor mounted to a drive mount, and a universal joint and a drive shaft connecting the drive motor to the bore honing tool.

13. The bore honing device according to claim 10, wherein:

the drive motor is a portable electric drill having a end with a handle for supporting and guiding the electric drill and a switch for activating the electric drill, and a drive output end, which engages the trolley, and a drill clutch for engaging a universal joint, which is connected to a drive shaft for driving the honing tool.

14. The bore honing device according to claim 10, wherein the adapter alignment assembly facilitates attaching the honing device in a desired relationship with the bore of a workpiece such that an axis of the honing tool is generally aligned with an axis of the bore.

15. A bore honing device comprising:

a support assembly including a first support element and a second support element which are connected by a support base, the support assembly supporting an axial guide track;

a trolley engages with and is movable along the guide track for guiding movement of a bore honing tool;

the trolley has a support for supporting the bore honing tool;

at least one adjustable guide stop is supported by the support assembly to limit axial movement of the trolley along the guide track; and a motor support bracket is secured to the trolley and has a releasable clamping mechanism for coupling a drive motor to the trolley; and the releasable clamping mechanism comprises a support plate which has a circular opening therein which receives and retains a housing of the drive motor to couple the drive motor to the bore honing device.

16. A bore honing device comprising:

a support assembly including a first support element and a second support element which are connected by a support base, the support assembly supporting an axial guide track;

a trolley engages with and is movable along the guide track for guiding movement of a bore honing tool;

the trolley has a support for supporting the bore honing tool;

at least one adjustable guide stop is supported by the support assembly to limit axial movement of the trolley along the guide track; and a weight compensation mechanism is connected to and located between the trolley and one of the first support element and the second support element of the support assembly, and the weight compensation mechanism applies a generally constant force on the trolley, when the bore honing device is operated in a vertical orientation, to compensate for a weight of at least a drive motor and the trolley.

17. The bore honing device according to claim 16, wherein the weight compensation mechanism comprises at least one coil spring, which is mounted to the trolley, an end attachment coupled to a free end of the at least one coil spring, a spring anchor, which is connected to the one of the first support element and the second support element, and a locking device for securing the end attachment to the spring anchor.

* * * * *